US011982097B2

(12) United States Patent
Powers, II et al.

(10) Patent No.: US 11,982,097 B2
(45) Date of Patent: May 14, 2024

(54) ADJUSTABLE ANGLE AND HEIGHT GUTTER DRAIN

(71) Applicant: BAPO Products, Inc., Ponte Vedra, FL (US)

(72) Inventors: Douglas Alex Powers, II, Ponte Vedra, FL (US); Dean Baker, Ponte Vedra, FL (US)

(73) Assignee: BAPO Products, Inc., Ponte Vedra, FL (US)

( * ) Notice: Subject to any disclaimer, the term of this patent is extended or adjusted under 35 U.S.C. 154(b) by 862 days.

(21) Appl. No.: 16/949,588

(22) Filed: Nov. 4, 2020

(65) Prior Publication Data

US 2022/0056720 A1 Feb. 24, 2022

Related U.S. Application Data

(63) Continuation-in-part of application No. 16/947,813, filed on Aug. 18, 2020, now Pat. No. 11,530,544.

(51) Int. Cl.
*E04H 4/12* (2006.01)
*E03F 5/04* (2006.01)

(52) U.S. Cl.
CPC ..... *E04H 4/1236* (2013.01); *E03F 5/04* (2013.01); *E03F 2005/0412* (2013.01)

(58) Field of Classification Search
None
See application file for complete search history.

(56) References Cited

U.S. PATENT DOCUMENTS 872,121 A * 11/1907 Greenlaw ..... F16L 27/04 285/263
918,144 A * 4/1909 Greenlaw ..... F16L 27/04 285/341
939,908 A * 11/1909 Greenlaw ..... F16L 27/04 285/263
1,568,649 A * 1/1926 Woodruff ..... F16L 27/067 285/271
1,779,936 A * 10/1930 Hess ..... E04D 13/0409 285/263
1,974,780 A * 9/1934 Smith ..... F16L 27/073 285/364
2,190,532 A * 2/1940 Lukomski ..... E03C 1/26 210/164
2,699,555 A * 1/1955 Green ..... F16K 5/061 137/550
3,276,796 A * 10/1966 Daniel ..... F16L 37/52 285/261

(Continued)

FOREIGN PATENT DOCUMENTS

CN 203626885 U 6/2014
CN 208650214 U 3/2019

(Continued)

*Primary Examiner* — Robert J Popovics
(74) *Attorney, Agent, or Firm* — Mark Young, PA

(57) ABSTRACT

A gutter drain includes a hopper with a convex bottom adjustably mated to a socket in the top of a drain tube. The socket is sized and shaped as a negative impression of the convex bottom, except that the depth of the socket is less than the depth of the convex bottom. A downtube from the drain tube is sized to fit into and mate with a vertical drain pipe. The hopper may be positioned and angled flush with a pitched surface of a gutter.

8 Claims, 16 Drawing Sheets

(56) References Cited

U.S. PATENT DOCUMENTS 3,361,450 A * 1/1968 Franck ..... F16L 27/047 285/271
3,582,114 A * 6/1971 Andersen ..... F16L 27/04 285/263
3,874,706 A * 4/1975 Arnold ..... F16L 19/08 285/24
4,088,348 A * 5/1978 Shemtov ..... F16L 27/04 285/263
4,298,219 A * 11/1981 Amelink ..... F16L 37/52 285/321
4,443,030 A * 4/1984 Hairston ..... F16L 37/52 285/55
4,489,962 A * 12/1984 Caumont ..... F16L 27/053 285/263
4,879,771 A * 11/1989 Piskula ..... E03F 7/00 4/256.1
4,883,590 A * 11/1989 Papp ..... E03F 5/0407 210/232
5,044,674 A * 9/1991 Hendrickson ..... F16L 27/0845 285/31
5,415,439 A * 5/1995 Wells ..... F16L 23/10 285/332.1
5,658,022 A * 8/1997 Shi ..... F16L 27/047 285/261
5,975,588 A * 11/1999 Hesseln ..... F16L 27/06 285/263
6,220,636 B1 * 4/2001 Veloskey ..... F16L 27/04 285/263
6,269,495 B1 * 8/2001 Sondrup ..... E03F 5/0407 210/163
6,350,373 B1 * 2/2002 Sondrup ..... E03F 5/0407 210/164
6,381,775 B1 * 5/2002 Sondrup ..... F16L 27/053 210/163
6,454,313 B1 * 9/2002 Dawson, Jr. ..... F16L 27/047 285/334.3
6,491,238 B1 * 12/2002 Swanson ..... A61H 33/6052 239/590.5
6,536,809 B2 * 3/2003 Marty ..... E03C 1/021 285/271
6,537,446 B1 3/2003 Sanguinetti
6,647,682 B2 * 11/2003 Bishop ..... E04D 13/0409 52/302.1
6,846,022 B2 * 1/2005 Takagi ..... F16L 27/023 403/56
6,889,916 B2 * 5/2005 Loyd ..... A61H 33/6063 4/541.1
6,955,499 B2 * 10/2005 Sondrup ..... E02D 29/1445 404/26
7,246,760 B2 * 7/2007 Marty ..... B05B 15/654 285/261
8,020,899 B2 9/2011 Hanna et al.
8,146,308 B2 * 4/2012 Warnecke ..... E03F 5/0407 285/44
8,347,424 B2 * 1/2013 Wroblewski ..... E04G 23/02 52/302.1
8,566,976 B2 * 10/2013 Evans ..... E03F 5/0407 4/286
9,015,870 B2 * 4/2015 Ball ..... E03C 1/22 4/286
9,015,876 B2 * 4/2015 Ball ..... E03C 1/22 285/46
9,157,555 B2 * 10/2015 Henry ..... F16L 5/025
9,175,797 B1 * 11/2015 Behoteguy ..... E03F 5/0404
9,322,157 B1 * 4/2016 Ismert ..... F16L 37/248
9,422,707 B2 * 8/2016 Hull ..... E03F 5/0404
9,422,708 B2 * 8/2016 Hull ..... E03F 5/041
10,113,303 B2 * 10/2018 Mardian ..... E03F 5/06
10,167,622 B2 * 1/2019 Brooks ..... E03F 5/06
10,184,238 B2 * 1/2019 Hull ..... B23P 15/00
10,233,609 B2 * 3/2019 Bonell ..... E02D 29/1409
10,334,839 B2 7/2019 Deurloo
10,480,170 B2 * 11/2019 Hull ..... E03F 5/0411
10,619,773 B2 * 4/2020 Zhou ..... F16L 27/073
10,746,332 B1 * 8/2020 Haines ..... F16L 27/06
10,781,951 B2 * 9/2020 Stoltz ..... B05B 15/18
10,961,714 B2 * 3/2021 Herrero-Smith .... E04D 13/0409
11,346,390 B2 * 5/2022 Anderson ..... F16L 39/04
11,530,544 B2 * 12/2022 Powers, II ..... E04H 4/1227
11,534,640 B1 * 12/2022 Swingley ..... B29C 66/322
11,674,294 B2 * 6/2023 Pilarczyk ..... F16L 27/107 4/679
11,920,350 B2 * 3/2024 Iftissen ..... E04D 13/0409
11,927,002 B2 * 3/2024 Yazdani ..... E03C 1/264
2006/0076773 A1 * 4/2006 Baharav ..... B29C 65/3432 285/146.1
2011/0173747 A1 * 7/2011 Evans ..... E03F 5/0407 4/679
2013/0193042 A1 * 8/2013 Hull ..... E03F 5/0409 210/164
2014/0020174 A1 * 1/2014 Evans ..... E03F 5/0407 4/679
2014/0138297 A1 * 5/2014 Hull ..... E03F 5/0407 210/164
2018/0112407 A1 * 4/2018 Herrero-Smith .... E04D 13/0767
2021/0317666 A1 * 10/2021 Majocka ..... E04D 13/0409
2022/0025653 A1 * 1/2022 Huber ..... E04D 13/0409
2022/0056720 A1 * 2/2022 Powers, II ..... E04H 4/1236
2022/0056721 A1 * 2/2022 Powers, II ..... E04H 4/1218
2022/0112973 A1 * 4/2022 Meyers ..... E03F 5/0408
2022/0120086 A1 * 4/2022 Majocka ..... E04D 13/0409
2022/0316215 A1 * 10/2022 Iftissen ..... E04D 13/0409
2023/0228087 A1 * 7/2023 Majocka ..... E04D 13/0409 285/42

FOREIGN PATENT DOCUMENTS

CN 209638597 U 11/2019
CN 210637662 U 5/2020
DE 4237320 A1 5/1994

* cited by examiner

SECTION K-K

ADJUSTABLE ANGLE AND HEIGHT GUTTER DRAIN

FIELD OF THE INVENTION

This invention relates generally to swimming pool gutters, and, more particularly, to a gutter drain with a separate hopper and drain pipe, a joint coupling the hopper to the drain pipe, and the angle of the joint being adjustable about at least one axis, and the height of the drain being adjustable.

BACKGROUND

Some swimming pools have gutters composed of a cementitious structure. Such gutters may be formed from a base of sprayed concrete, such as shotcrete or gunite. Typically, such gutters are finished with a plaster mortar, such as the crushed marble containing mortar known as marcite or any of various commercially available quartz aggregate or glass bead finishes. The base and finishing coating comprise the gutter structure.

Drains are provided in such gutters. Conventional drains are an integrally formed PVC structures, each including a hopper (e.g., a funnel-like receptacle) and a drain tube. A separate cover plate is attached to an open top of the hopper. The cover plate has openings through which water may flow into the hopper. From the hopper, the water flows into the drain tube. The drain tube is fluidly coupled to plumbing that ultimately leads to filtration and pumping systems of the swimming pool. After filtration, the water is returned to the pool.

While the top surface of the gutter is pitched, conventional drains are not. Rather, the cover plate of a conventional drain, when installed, is typically horizontal and orthogonal to the longitudinal axis of the drain tube. Thus, the cover plate and top of a hopper of a conventional drain does not match the slope of the gutter. This mismatch results in one or more edges of the drain extending above or below the gutter surface. Such a configuration is unsightly and inefficient for drainage, as the raised edge interferes with water flow along the gutter surface.

Additionally, eventually, pools, including gutters, require resurfacing. The resurfacing tends to cover old material and increase the height of the gutters. To keep the top of a gutter drain flush with the increased height of the gutter, pool resurfacers have devised a few techniques. One technique entails cutting a top portion of the installed drain structure and embedding it in the new surface material. This leaves a gap between top portion and the remainder of the drain structure. Even if the gap is cemented, over time, leaks develop at the gap.

A more drastic technique entails excavating down to the pipe to which the drain is attached. Then, the entire drain structure and a portion of the pipe is cut and removed. Then the cut pipe is extended with a coupler and a new gutter drain is installed at the correct height for the gutter. Problems with this approach are increased time and cost, for which a customer may be reluctant to pay. Additionally, the excavation may lead to collateral damage to nearby tiles and other structures.

A gutter drain with an adjustable angle hopper is needed. The drain should be adaptable for original construction or use as a replacement drain, without requiring excavation. The invention is directed to overcoming one or more of the problems and solving one or more of the needs as set forth above.

SUMMARY OF THE INVENTION

To solve one or more of the problems set forth above, in an exemplary implementation of the invention, a gutter drain includes a hopper with a convex bottom adjustably mated to a socket in the top of a drain tube. The socket is sized and shaped as a negative impression of the convex bottom, except that the depth of the socket is less than the depth of the convex bottom. A downtube of the drain tube is sized to fit into and mate with a vertical drain pipe. The hopper may be positioned and angled flush with a pitched surface of a gutter.

In an exemplary embodiment, the adjustable gutter drain includes a hopper. The hopper defines a receptacle with an open top and a bottom. A first joint member extends from the bottom. A passage extends from the receptacle through the first joint member. A drain tube has a drain tube top, a second joint member, and a downtube. The downtube extends from the drain tube top. The second joint member is formed at the drain tube top. A channel extends through the second joint member and the downtube. The first joint member abuts the second joint member. One of the first joint member and the second joint member is a negative impression of the other of the first joint member and the second joint member. An angle of the first joint member relative to the second joint member is adjustable over a range of angles, e.g., a continuum of angles from a minimum angle to a maximum angle.

The downpipe has an outer diameter sized to mate with a drain pipe by fitting within the drain pipe. Such a downpipe may have an outer diameter sized to mate with a 2-inch nominal pipe size Schedule 40 PVC drain pipe by fitting snugly within the drain pipe. The downpipe may have an outer diameter of about 2.047 inches, or between 2.03 and 2.05 inches.

The first joint member may be a male or female portion of a joint. For example, the first joint member may be a concave projection extending from the bottom of the hopper, such as a spherical cap or cylindrical cap extending from the bottom of the hopper. Alternatively, the second joint member may be a concave projection extending from the drain tube top, such as a spherical cap or cylindrical cap extending from the drain tube top.

The first joint member may abut and be attached to the second joint member while the downtube is inserted into and attached to the drain pipe. The first joint member may be attached to achieve an angle of the hopper that is about the same as the pitch of a gutter. Additionally, the downtube may be inserted into the drain pipe to a depth for the top of the hopper to be flush with the pitched surface of the gutter.

While the drain may comprise any of various materials, including plastics and metals, polyvinyl chloride (PVC) plastic is preferred. PVC is lightweight, cost-effective, durable, long-lasting and widely used in the industry.

A bonding agent, such as a PVC cement, joins the bottom of the hopper to the top of the drain tube at the set angle, and the downtube in the drain pipe. By way of example and not limitation, the bonding agent may comprise a solution of polymers in a suitable solvent or solvent mix. The solvent mix for a PVC cement may include tetrahydrofuran (THF), or N-Methy-pyrrolidone (NMP), or dimethylsulfoxide (DMSO), or dimethylformamide (DMF), or others.

A method of installing the replacement drain in a pool gutter includes cutting the joint defined by the proximal end of the drain pipe received in the distal end of the original drain tube. The joint may be cut using an internal pipe cutter. Upon cutting, a first portion of the original drain tube remains attached to and extends from the bottom of the original hopper of the original drain, a first portion of the drain pipe remains received in the first portion of the original drain tube, a second portion of the original drain tube is not attached to the bottom of the original hopper of the original drain, and a second portion of the drain pipe remains received in the second portion of the original drain tube. The original hopper of the original drain, first portion of the original drain tube, and first portion of the drain pipe are removed together as a unit. Upon removal, the second portion of the original drain tube and the second portion of the drain pipe are left in place. Then the replacement drain is installed by angling the hopper relative to the replacement drain tube and inserting the distal end of the replacement drain tube into the second portion of the drain pipe. A replacement joint is defined by the replacement drain tube received in the second portion of the drain pipe, and the second portion of the drain pipe received in the second portion of the original drain tube.

A bonding agent (e.g., PVC cement) is applied to the joint between the hopper and replacement drain tube and also to the distal end of the replacement drain tube before inserting it into the second portion of the drain pipe. If necessary to achieve a desired elevation of the top of the hopper, the replacement drain tube may be trimmed to a determined length before inserting the distal end of the replacement drain tube into the second portion of the drain pipe. To determine the length of the drain tube, the replacement drain tube may be dry fit in the second portion of the drain pipe before trimming the replacement drain tube to a determined length and before applying a bonding agent. Upon installing the replacement drain, the top surface of the pool gutter is surfaced (e.g., finished with a mortar) to be substantially level with the top of the replacement hopper.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 9:
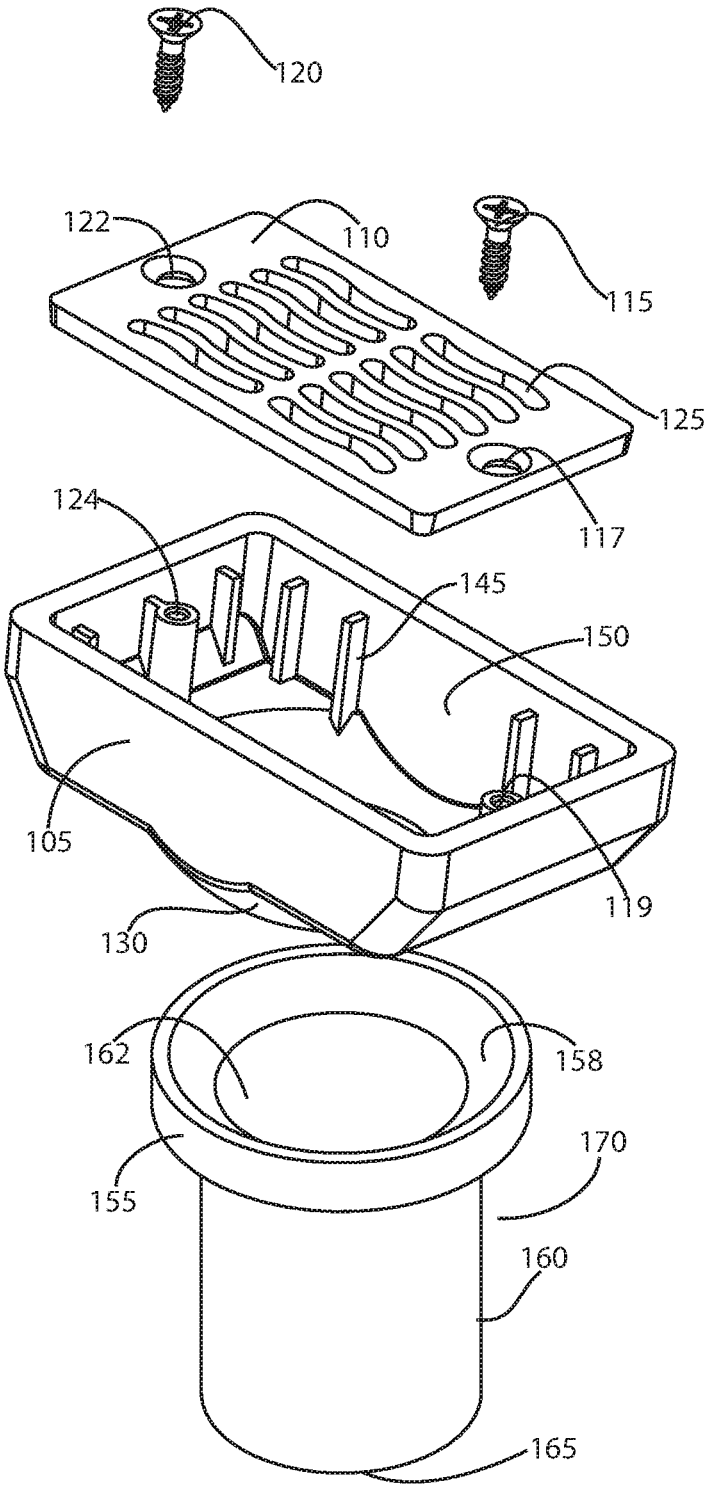
FIG. 9 is an exploded perspective view of an exemplary gutter drain according to principles of the invention.
Figure 10:
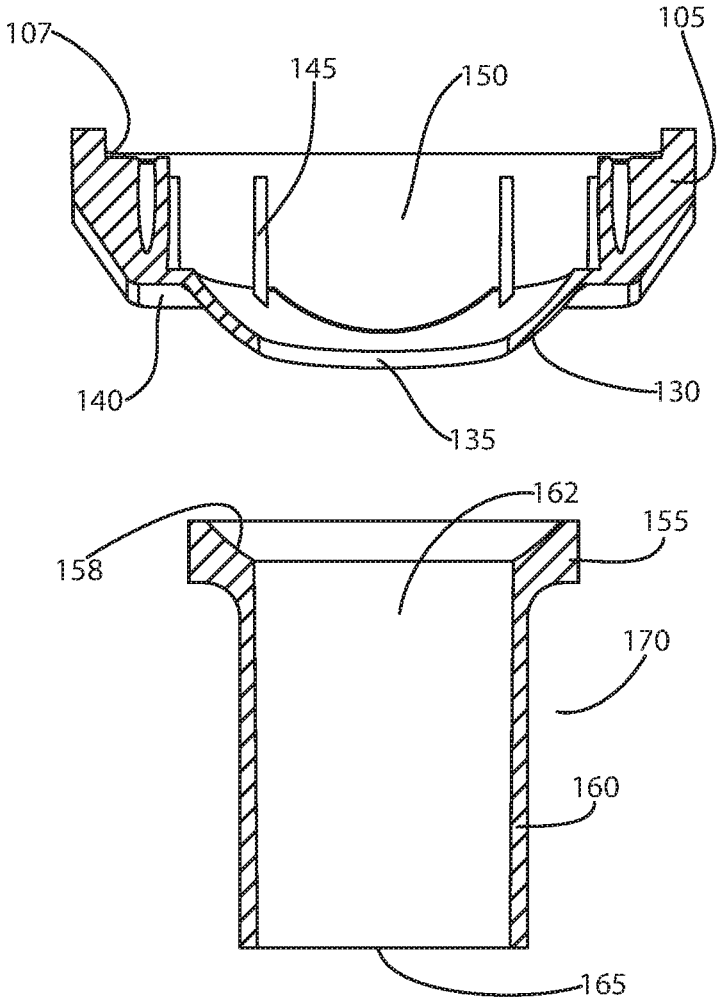
FIG. 10 is an exploded front section view of components of an exemplary gutter drain according to principles of the invention.

Referring to the figures, an exemplary replacement drain 100 for a pool gutter 220 includes a removable cover 110 with a plurality of drain apertures 125, a hopper 102 with a top 105, a convex bottom 130 with and oculus 135, and a drain tube 170 with a top 155 defining an interior socket 158 (FIGS. 5, 6 and 9) and a downpipe 160 with a central passage 162 leading to an open distal end 165.

Figure 1:
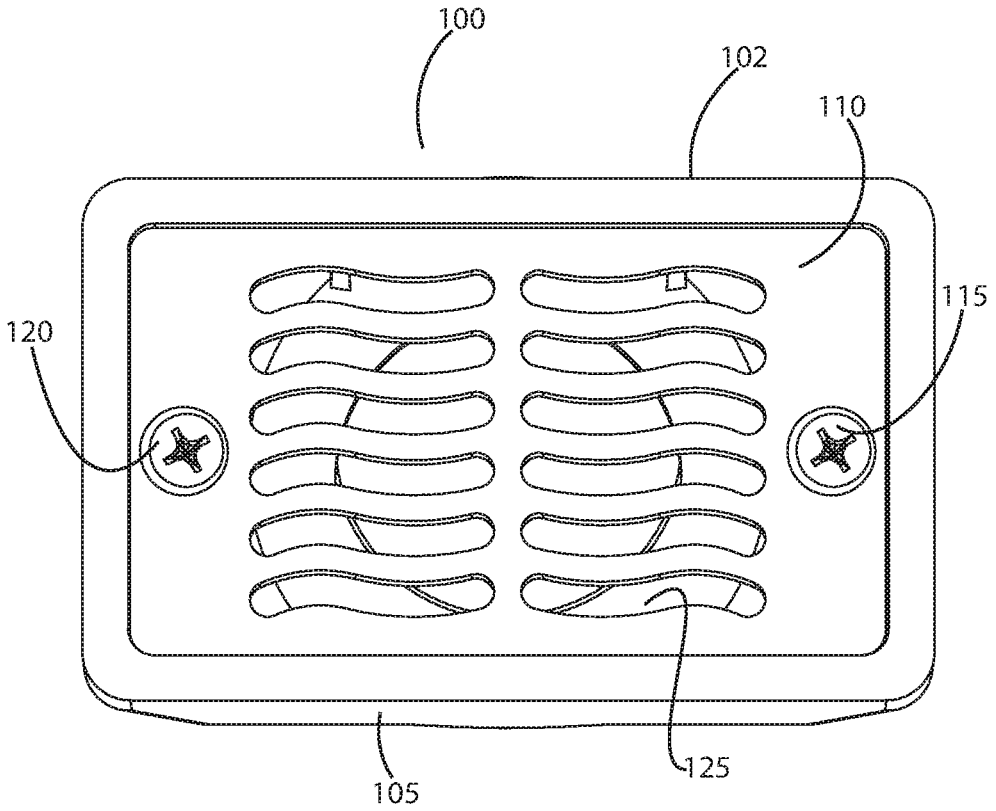
FIG. 1 is a plan view of an exemplary gutter drain according to principles of the invention.

Referring to FIG. 1, the cover 110 is a thin panel secured to the top 105 of the hopper 102. The cover 110 is removable. In the exemplary embodiment, screws 115, 120 extend through holes in the cover 110 into screw bosses formed in the top 105 of the hopper. The cover 110 includes a plurality of drain apertures 125 to filter debris from drain water.

Figure 2:
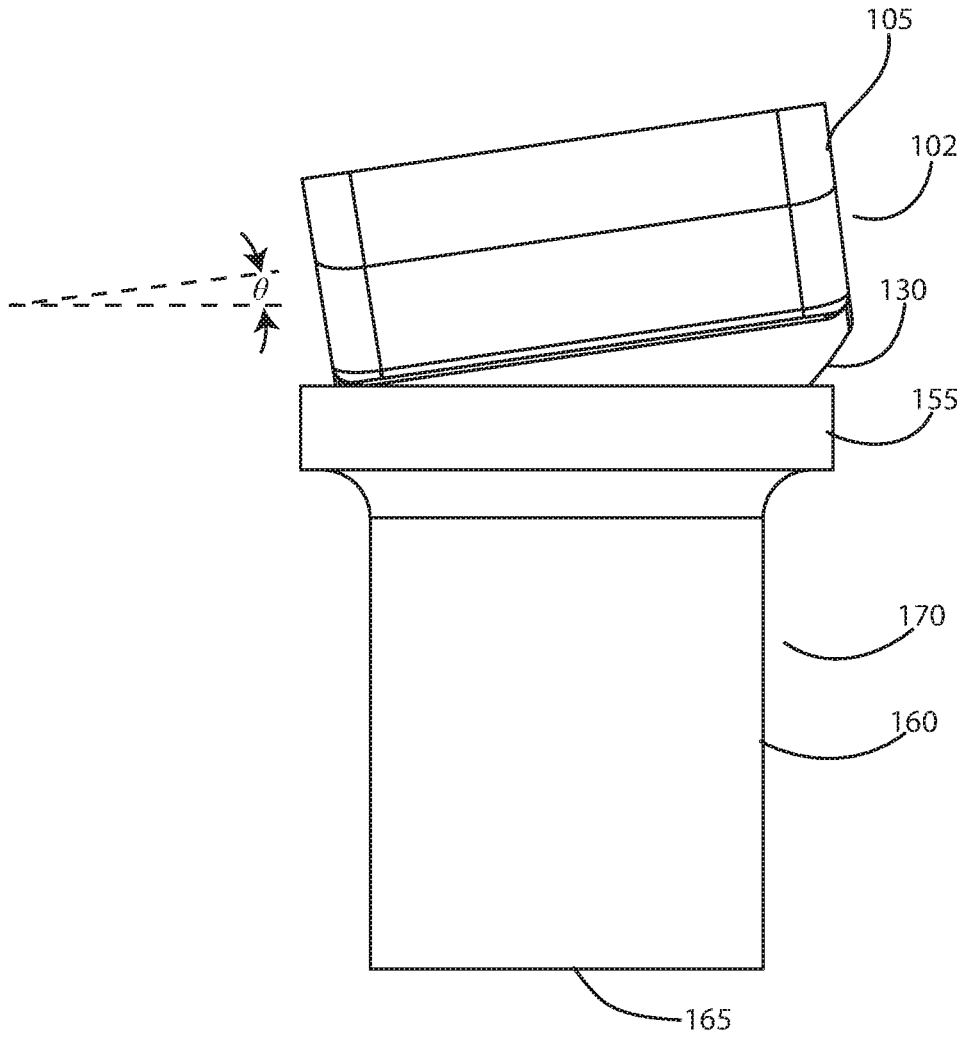
FIG. 2 is a side view of an exemplary gutter drain according to principles of the invention.
Figure 3:
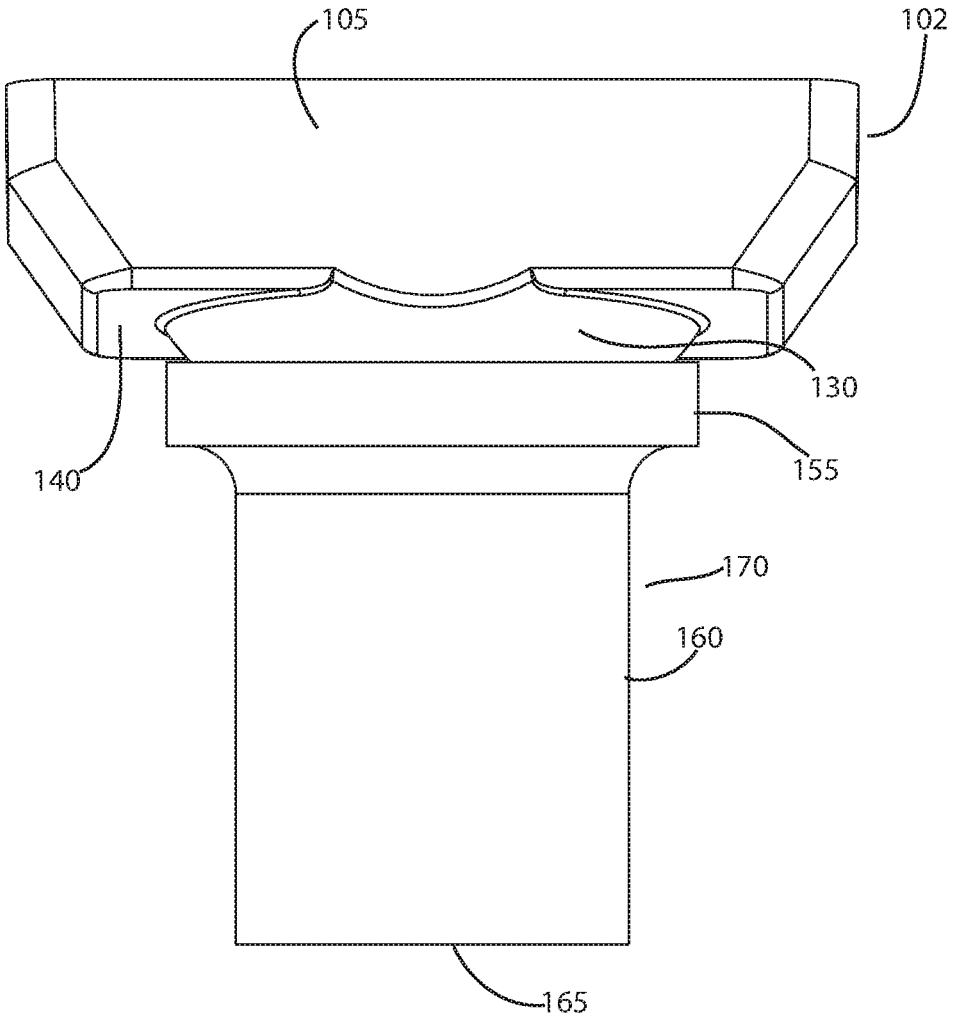
FIG. 3 is a front view of an exemplary gutter drain according to principles of the invention.
Figure 4:
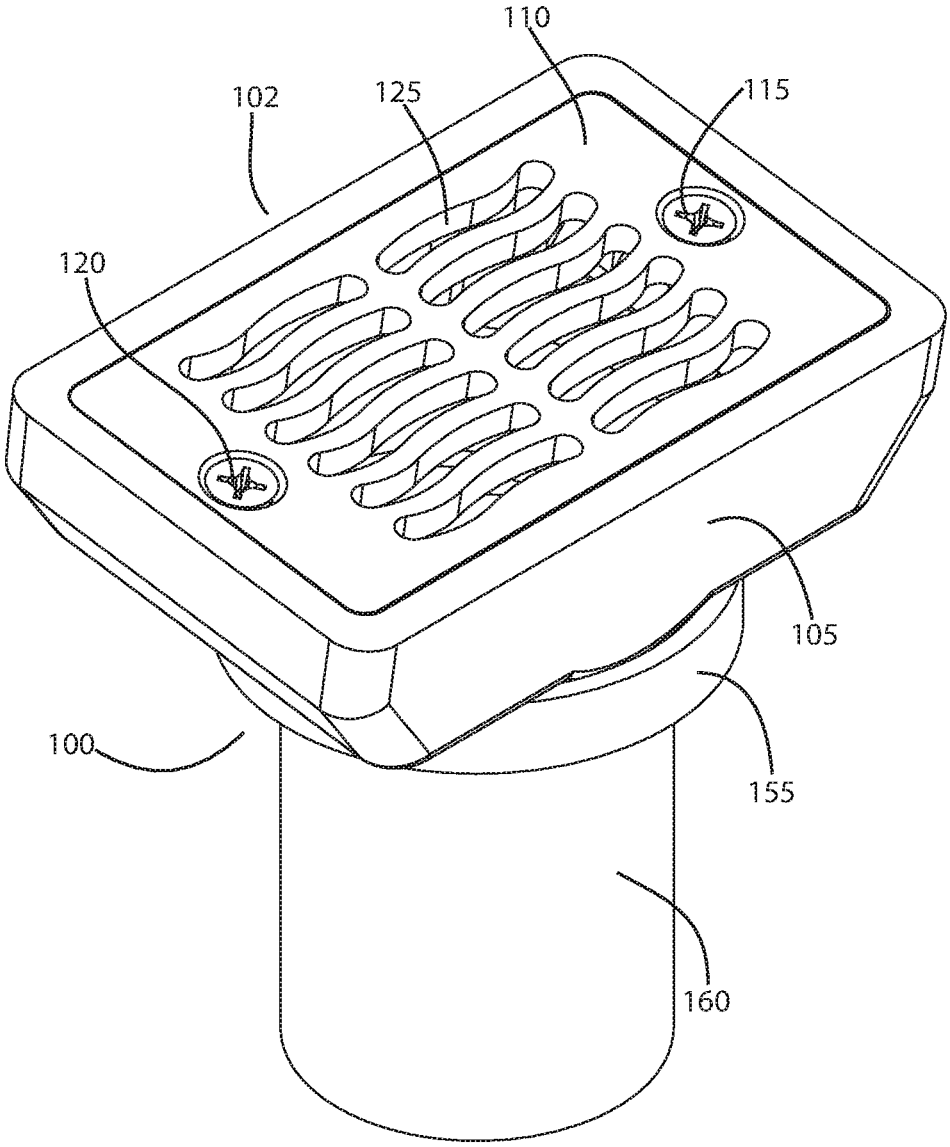
FIG. 4 is a top perspective view of an exemplary gutter drain according to principles of the invention.

FIGS. 2-4 provide views of an exemplary gutter drain 100. The convex bottom 130 is seated in a socket 158 (FIGS. 5, 6 and 9) defined within the top 155 of the drain tube 170, as discussed in more detail below. The socket 158 provides a negative impression of a received portion of the convex bottom 130. The convex bottom 130 mates with the socket 158 by being received, in part, in the socket 158. The angle θ of the hopper 102 (i.e., the angle of a plane intersected by and perpendicular to a longitudinal central axis extending from the top 105 through the oculus 135 of the hopper 102) relative to the horizon is adjustable. The hopper angle θ may be adjustable within a range of possible angles. The range of angles may, by way of example and not limitation, be from −30° to +30°, or from −20° to +20°, or from −10° to +10°, or from 0° to +30°, or from 0° to +20°, or from −0° to +10°. In a preferred implementation, during installation, the angle θ is set to conform with the angle (pitch) of a surface of a gutter.

A bonding agent, such as a PVC cement, may be used to join the convex bottom 130 of the hopper 102 to the interior socket 158 in the top 155 of the drain tube 170, at a desired angle θ. By way of example and not limitation, the bonding agent may comprise a solution of polymers in a suitable solvent or solvent mix. The solvent mix for a PVC cement may include tetrahydrofuran (THF), or N-Methyl-2-pyrrolidone (NMP), or dimethylsulfoxide (DMSO), or dimethylformamide (DMF), or others. Such a bonding agent may also be used to bond other components, as discussed below.

Figure 17:
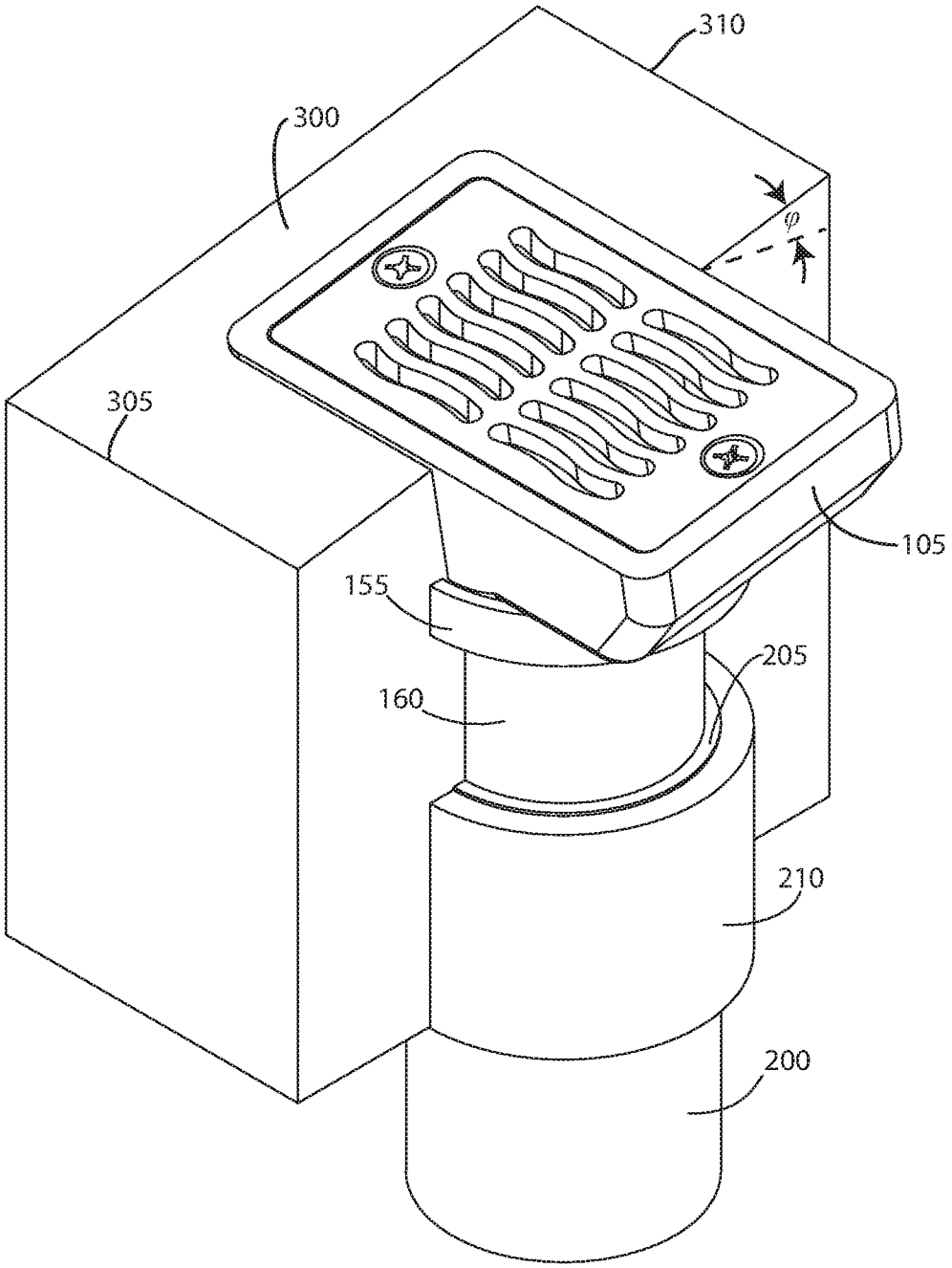
FIG. 17 is a perspective view of an exemplary gutter drain installed in a gutter according to principles of the invention.

In an exemplary embodiment, the replacement drain 100 is configured to adapt to existing plumbing, as conceptually illustrated in FIG. 17. In particular, the downpipe 160 may mate and fit within the interior of a drain pipe 200 of existing plumbing. Illustratively, the drain tube 170 has a top 155 (proximal end), a downpipe 160, an outer diameter, $d_o$, and a distal end 165. A drain pipe 200, which is fluidly coupled to pool recirculation plumbing, has an inner diameter, an outer diameter and a proximal end, e.g., top end 206. The distal end 165 of the drain tube 170 is sized and shaped to be securely received in the proximal end 206 of the drain pipe 200. Additionally, a portion of a drain tube 205 of a replaced drain has an inner diameter at least equal to the outer diameter of drain pipe 200. A portion of the drain pipe 200 is securely received in the drain tube portion 205 of the replaced drain. The outer diameter of the drain tube 170 of the replacement drain 100 is not greater than, but is about the same as, the inner diameter of the drain pipe 200. The inner diameter of the drain tube 205 of the replaced drain is not less than, but is about the same as, the outer diameter of the drain pipe 200. A liquid flow path is defined by the hopper 102, drain pipe 160 and drain pipe 200. A joint 220 is thus defined by the distal end 165 of the drain tube 170 received in the proximal end 206 of the drain pipe 200, and the proximal end of the drain pipe 200 received in remaining portion of the replaced drain tube 205. This joint 220 includes three concentric layers, including an inner layer comprising the distal end 165 of the replacement drain tube 170, a medial layer comprising the proximal end 206 of the drain pipe 200, and an outer layer comprising the distal end of the drain tube 205 of the replaced drain. The bonding agent, such as a PVC cement, as described above, may join the distal end 165 of the replacement drain tube 170 within the proximal end 206 of the drain pipe 200. As a result of the multiple layers, such joint 220 is structurally reinforced.

Figure 5:
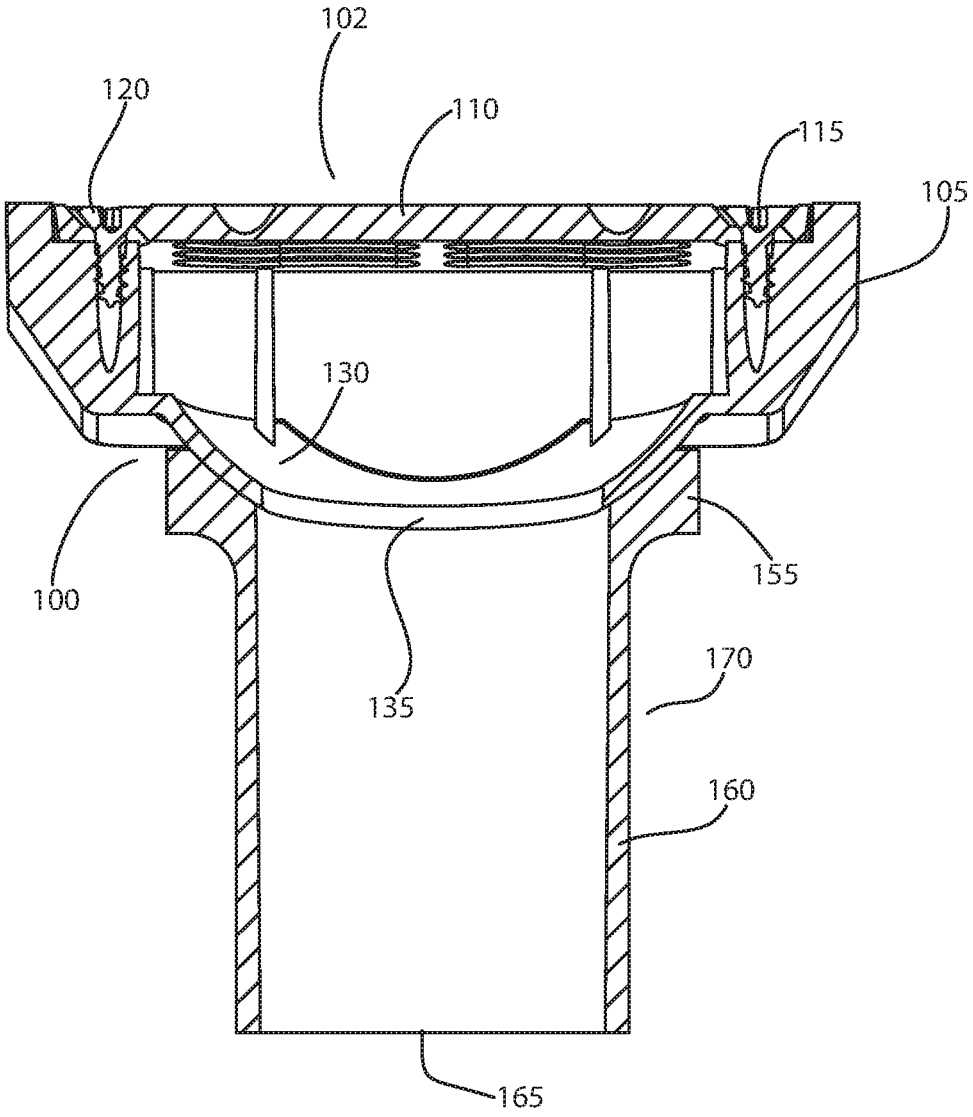
FIG. 5 is a front section view of an exemplary gutter drain according to principles of the invention.
Figure 6:
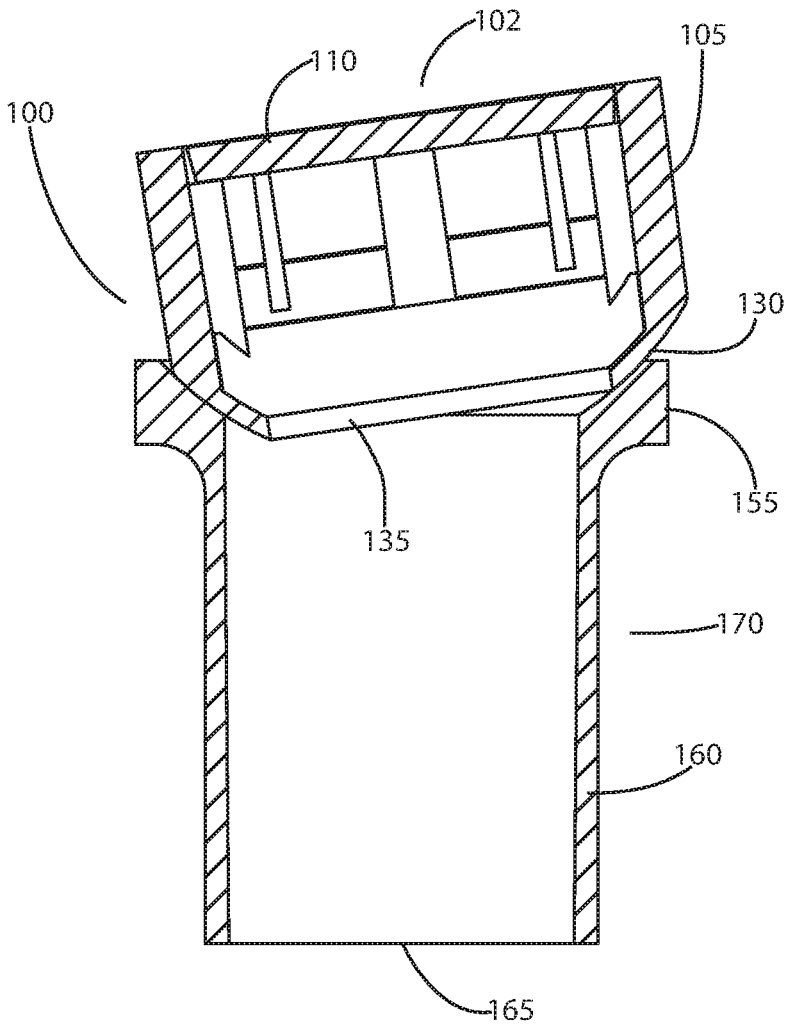
FIG. 6 is a side section view of an exemplary gutter drain according to principles of the invention.
Figure 7:
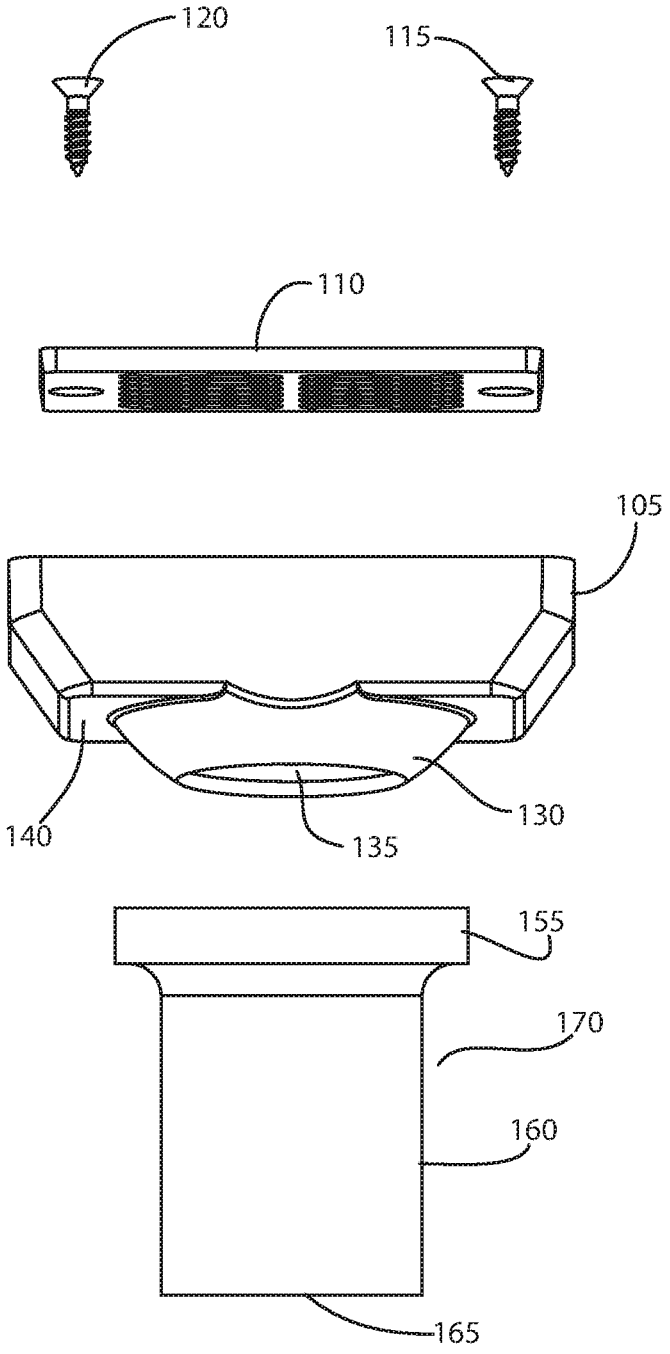
FIG. 7 is an exploded front view of an exemplary gutter drain according to principles of the invention.
Figure 8:
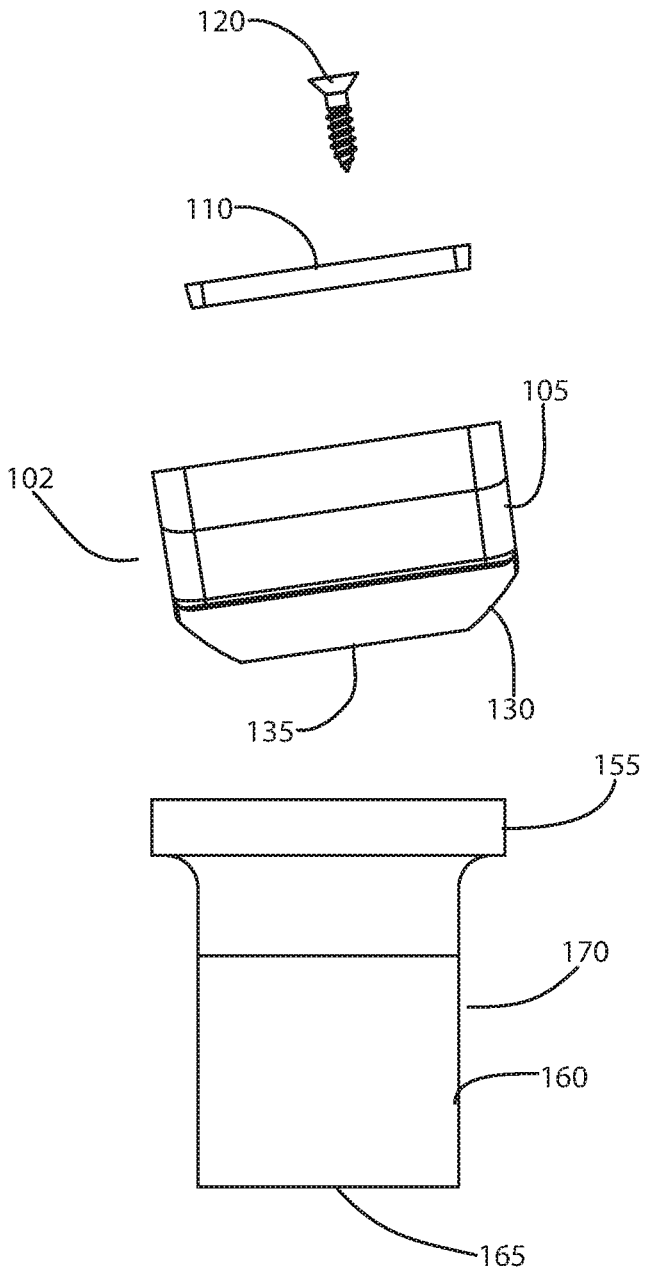
FIG. 8 is an exploded side view of an exemplary gutter drain according to principles of the invention.

FIGS. 5 and 6 provide section views of the assembled drain 100. The inner diameter, $d_i$, of downpipe 160 is shown, revealing a thin walled structure typical of PVC plumbing. Reinforcing ribs 145 formed in the interior of the hopper 102 strengthen the thin walled structure of the hopper 120. The section views illustrate the convex bottom 130 of the hopper 102 seated in the socket 158 defined within the top 155 of the drain tube 170. A substantial portion, but not the entirety, of the convex bottom 130 of the hopper 102 mates with, i.e., directly abuts, the socket 158 defined within the top 155 of the drain tube 170. The oculus 135 aligns with the central passage 162 to provide a flow path from the hopper 102 through the drain tube 170.

The exploded views of FIGS. 7-10 more clearly illustrate the interior 150 of the hopper 120; bosses 119, 124 for receiving screws 115, 120; holes 117, 122 in the cover 110 for screws 115, 120; the contour of the exemplary convex bottom 130 of the hopper 102 and the corresponding shape of the socket 158 defined within the top 155 of the drain tube 170. In geometry, a spherical cap is a portion of a sphere cut off by a plane. If the plane passes through the center of the sphere, so that the height of the cap is equal to the radius of the sphere, the spherical cap is called a hemisphere. The exemplary convex bottom 130 is a spherical cap from a hollow sphere (i.e., a thin walled spherical structure) with a central window (i.e., oculus 135). In the exemplary embodiment, the height of the spherical cap is less than or equal to (not greater than) the radius of a sphere from which the cap is formed. Thus, the spherical cap is not greater than a hemisphere. The socket 158 is a negative impression of a received portion of the spherical cap with a central passage 162. The socket 158 is sized to receive a substantial portion, but not the entirety, of the spherical cap. The height of the socket 158, $h_s$, is less than the height of the spherical cap $h_c$ (i.e., the height of the convex bottom 130). Expressed mathematically, $h_s<h_c$. This arrangement allows the hopper 102 to be pivoted to a desired angle relative to the drain tube 170, without the bottom 140 of the hopper 102 hitting the top 155 of the drain tube 170 and thereby preventing pivoting to such desired angle. The range of angles can be increased by decreasing the ratio $h_s/h_c$, which is the ratio of the height of the socket 158, $h_s$ to the height $h_c$ of the convex bottom 130. By way of example, a convex bottom 130 that extends outward from the socket 158 only slightly when seated at an angle $\theta=0°$ can pivot to angles in a limited range before the bottom 140 of the hopper 102 contacts the top 155 of the drain tube 170, thereby preventing pivoting to angles outside the range. However, a convex bottom 130 that extends further from the socket 158 when seated at an angle $\theta=0°$ can pivot to angles in a wider range before the bottom 140 of the hopper 102 contacts the top 155 of the drain tube 170.

When the convex bottom 130 is bonded to the socket 158 with a bonding agent, such as PVC cement, the angle, $\theta$, is fixed and a fluid-tight joint is provided. Before the convex bottom 130 is bonded to the socket 158 with a bonding agent, such as PVC cement, the angle, $\theta$, is adjustable.

The configuration provides an adjustable angle fitting, with an angle that may be set while the drain 100 is located in a gutter, and that does not require a complex socket with parts that must be disassembled to seat the convex bottom 130. If the socket were to receive a spherical cap with a height greater than the radius, then the socket would have to be comprised of a plurality of components, with at least one removable component (e.g., a tube nut) to provide access to seat the spherical cap. This would require reassembly of the drain after the spherical cap is seated. This would prevent setting the angle, $\theta$, while the drain is located in a gutter.

The drain tube 170 has an open top 155. The top 155 of the drain tube 170 is devoid of a removable cover that partially or wholly covers the top 155. The open top 155 allows the convex bottom 130 of the hopper 102 to enter and mate with the socket 158 by inserting the convex bottom 130 into the socket 158. A fluid impermeable joint may be formed by applying a bonding agent (e.g., PVC cement) to the convex bottom 130 and/or to the socket 158, before the convex bottom is inserted into and seated in the socket 158. This configuration (i.e., the absence of a top cover) enables mating of the hopper 102 with the drain tube 170 in a gutter.

Figure 13:
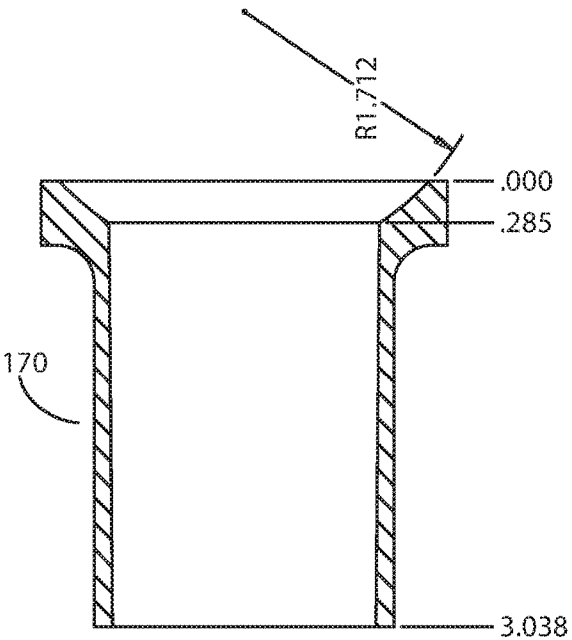
FIGS. 11-13 are dimensioned drawings of a nonlimiting example of a drain tube of an exemplary gutter drain according to principles of the invention.
Figure 11:
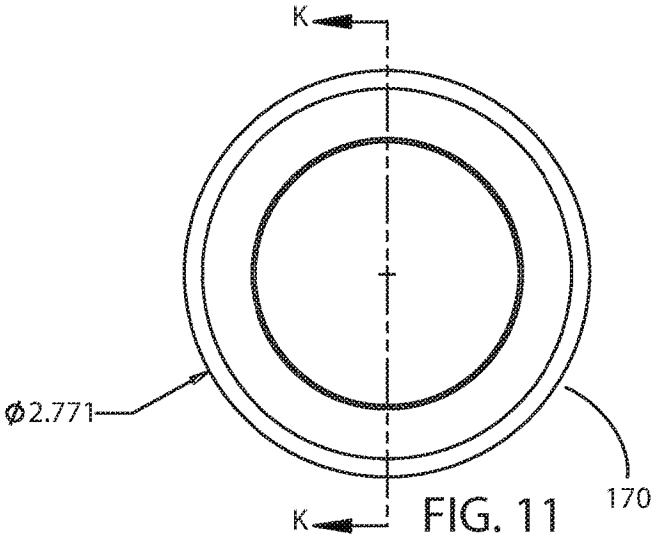
Figure 12:
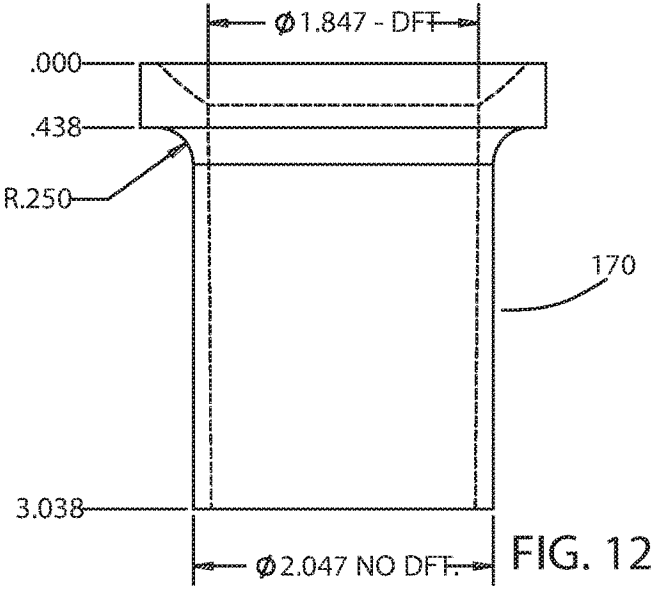
Figure 14:
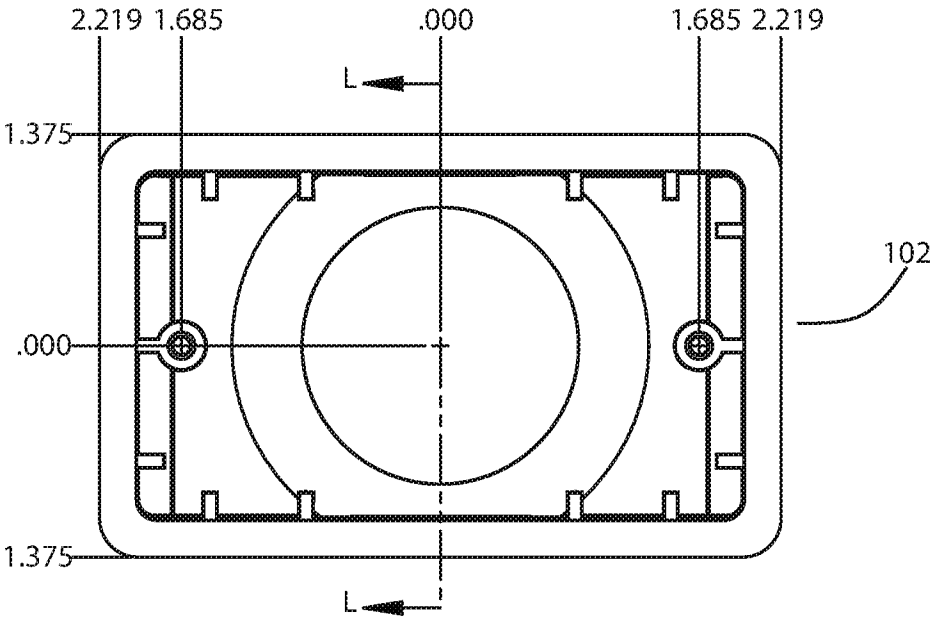
FIGS. 14-16 are dimensioned drawings of a nonlimiting example of a hopper of an exemplary gutter drain according to principles of the invention.
Figure 15:
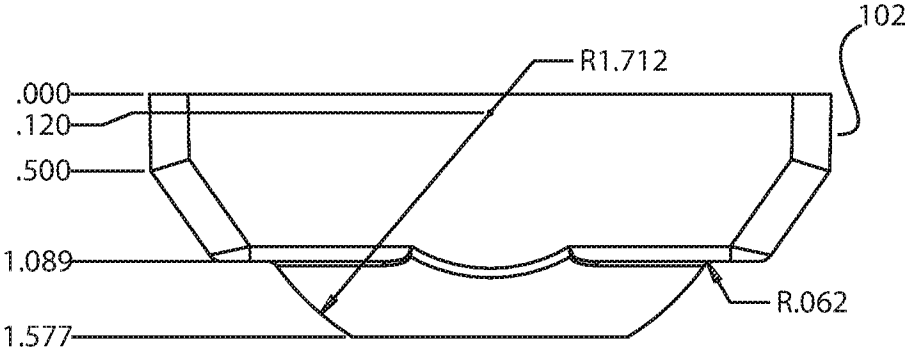
Figure 16:
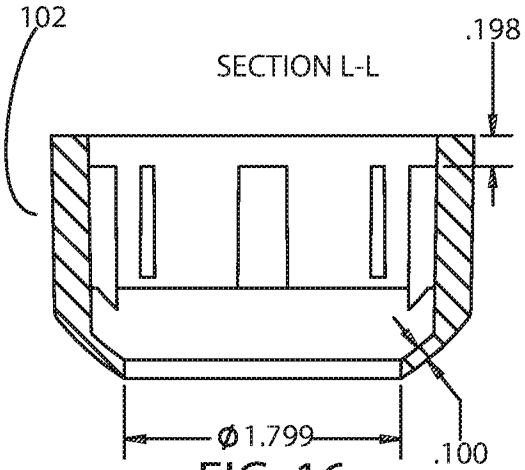

Not limiting examples of a dimensioned drain tube 170 and hopper 102 are provided in FIGS. 11-16, respectively. The dimensions are in inches. In the exemplary dimensioned embodiment, the radius (1.712") of the socket 158 as shown in FIG. 13 is the same as the radius of the convex bottom 130 as shown in FIG. 15. The height (0.285") of the socket 158, as shown in FIG. 13, is less than the height (0.488", which equals 1.577-1.089) of the convex bottom 130 as shown in FIG. 15. The diameter (1.799") of the oculus 135 as shown in FIG. 16 is less than the inner diameter (1.847") of the downpipe 160 as shown in FIG. 12. The length (2.600") of the downpipe 160 is sufficient to reach and mate with a drain pipe 200. The outer diameter (2.047") of the downpipe 160 is about the same as the inner diameter of a 2" nominal pipe size Schedule 40 PVC pipe, as commonly used in plumbing for swimming pool gutters. In another embodiment, the outer diameter of the downpipe 160 may be between 2.03 and 2.05 inches, with any excess being sanded off to facilitate insertion and any gap filled with PVC cement. Thus, the downpipe 160 may be slid into and bonded with existing pool gutter plumbing.

FIG. 17 is a perspective view of an exemplary gutter drain 100 installed in a gutter 300 according to principles of the invention. The gutter drain has a first edge 305, an opposite second edge 310, and a pitched generally planar surface (pitched at angle φ) extending from edge 305 to edge 310. The downtube 160 is received in the proximal (top) end 206 of the drain pipe 200. The drain pipe 200 is a part of the plumbing for the gutter 300. Typically, the drain pipe 200 is 2" nominal pipe size Schedule 40 PVC pipe. The outer diameter, $d_o$, of the downpipe 160 is about the same as the inner diameter of the drain pipe 200. A bonding agent (e.g., PVC cement) may be applied to the distal end of the downtube 160 before inserting it into the top end 206 of the drain pipe 200. The top 105 of the hopper 102 is angled so that the top 110 is about flush with the pitched planar surface of the gutter 300.

A portion 205 of a downtube of an originally installed drain is illustrated in FIG. 17. The originally installed drain may have been removed, as described below with reference to the flowchart of FIG. 21. After removal of the original drain, a portion 205 of the downtube of the original drain remains around the end 206 of the drain pipe 200. Conventional drains used heretofore mate with the drain pipe 200 by receiving a portion of the drain pipe in the distal (bottom) end 205 of the downtube. Additionally, conventional drains used heretofore do not have a hopper with an adjustable angle.

Figure 19:
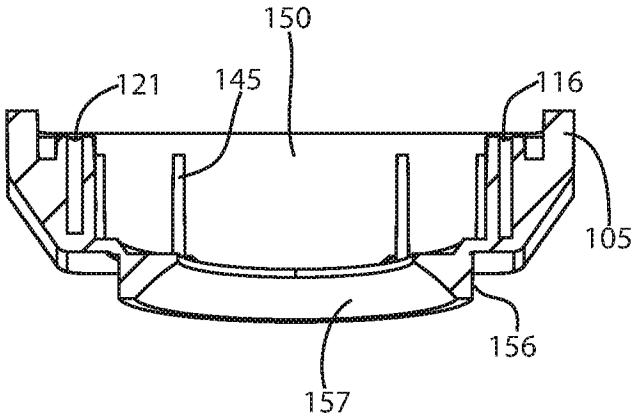
FIGS. 18-19 conceptually illustrate another nonlimiting example of a hopper and drain tube for an exemplary gutter drain according to principles of the invention.
Figure 18:
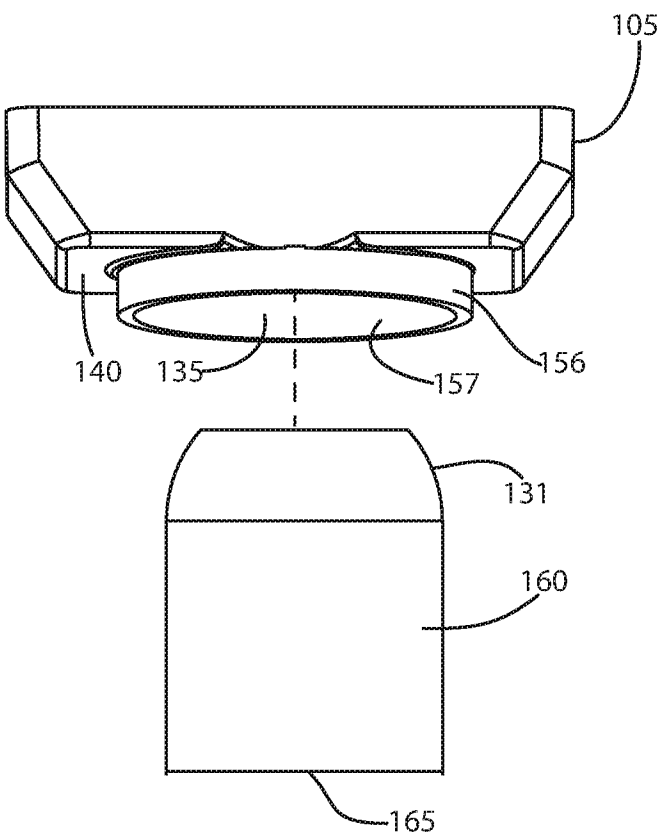

In FIGS. 1-17, the joint between the hopper 102 and the downpipe 160 includes a male portion, i.e., the concave bottom 130, extending from the bottom 140 of the hopper 102, and a female portion, i.e., the socket, defined in the top 155 of the drain tube 170. However, the female portion may be provided at the bottom 140 of the hopper 102, and the male portion may be provided at the top 155 of the drain tube 170, without departing from the scope of the invention. By way of example and not limitation, a convex top 131 is provided on the downtube 160 in FIG. 19. The mating socket 157 is provided in a sleeve 156 at the bottom 140 of the hopper 102, as shown in FIGS. 18 and 19. Thus, the invention is not limited to the relative locations of the male and female joint elements. The embodiment in FIGS. 18-19 and the embodiments in FIGS. 1-17 are equivalent. They perform the same function, in substantially the same way to achieve the same result. Both embodiments allow adjusting the angle of hopper by adjusting a male concave element in a mating female socket. Both embodiments include a downtube configured to mate with an existing drain pipe 200 by fitting within the drain pipe 200.

Figure 20:
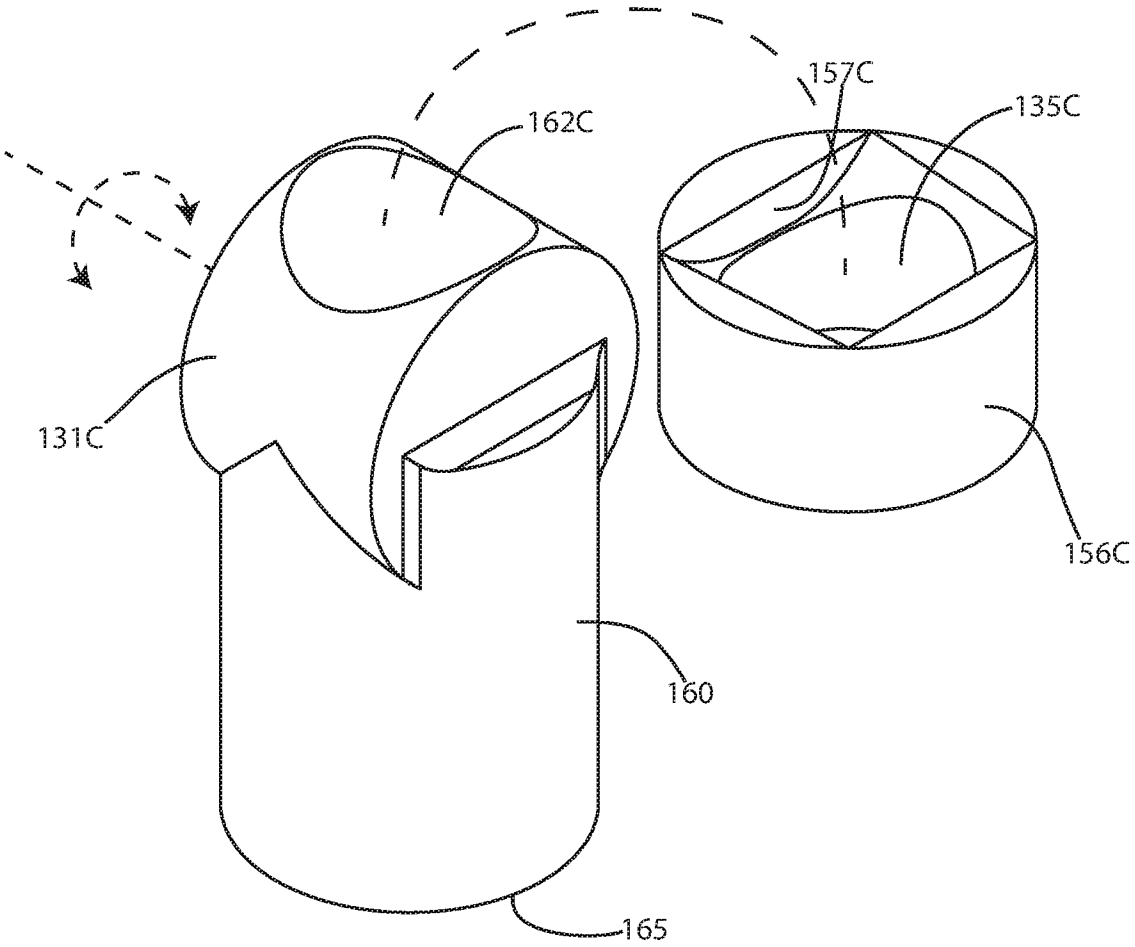
FIG. 20 conceptually illustrates a nonlimiting example of a hopper neck and drain tube for an exemplary gutter drain according to principles of the invention.

In FIGS. 1-17, the joint between the hopper 102 and the downpipe 160 includes a male portion, i.e., the concave bottom 130, extending from the bottom 140 of the hopper 102, and a female portion, i.e., the socket, defined in the top 155 of the drain tube 170. In FIGS. 18 and 19, the locations of the female and male portions are swapped. In FIG. 20, the shapes of the female and male portions are changed. Instead of a spherical cap, the male portion 131*c* is cylindrical, i.e., a cylindrical cap. Instead of a negative impression of a spherical cap, the socket 157*c* in a collar 156*c* that is formed (or attached) to the bottom 140 of a hopper 102 (not shown in FIG. 20) is a negative impression of the cylindrical cap male portion 131*c*. Unlike the embodiments in FIG. 1-19 which may pivot about multiple orthogonal axes, the embodiment in FIG. 20 may pivot about one axis.

In sum, a joint couples the hopper 102 to the downtube 160. The joint includes a male portion and a female portion. The female portion is the negative impression of the male portion. One of the male or female portion is attached to the bottom 140 of the hopper 102, while the other of the male or female portion is attached to the top of the drain tube 170. The male portion may be a spherical cap or a cylindrical cap, while the female portion is a negative impression of the male portion. The joint, comprised of the female and male portion, is configured to allow pivoting of the hopper 102 in relation to the downpipe 160. Such pivoting adjusts the angle of the hopper 102 about at least one axis. Such adjustment allows angling the hopper to the same (or substantially the same) pitch of the gutter.

Concomitantly, the downpipe 160 is configured (i.e., sized and shaped) to be snugly received within the gutter plumbing drain pipe 200. The downpipe 160 is sufficiently long to extend into the top 206 of the drain pipe 200, below the surface of the gutter 300, while the top 105 of the drain 100 remains substantially flush with the pitched surface of the gutter 300. Thus, the downpipe configuration and the joint allow the hopper to be installed in existing plumbing, or in new plumbing, and with the top of the hopper being flush with a pitched gutter.

Figure 21:
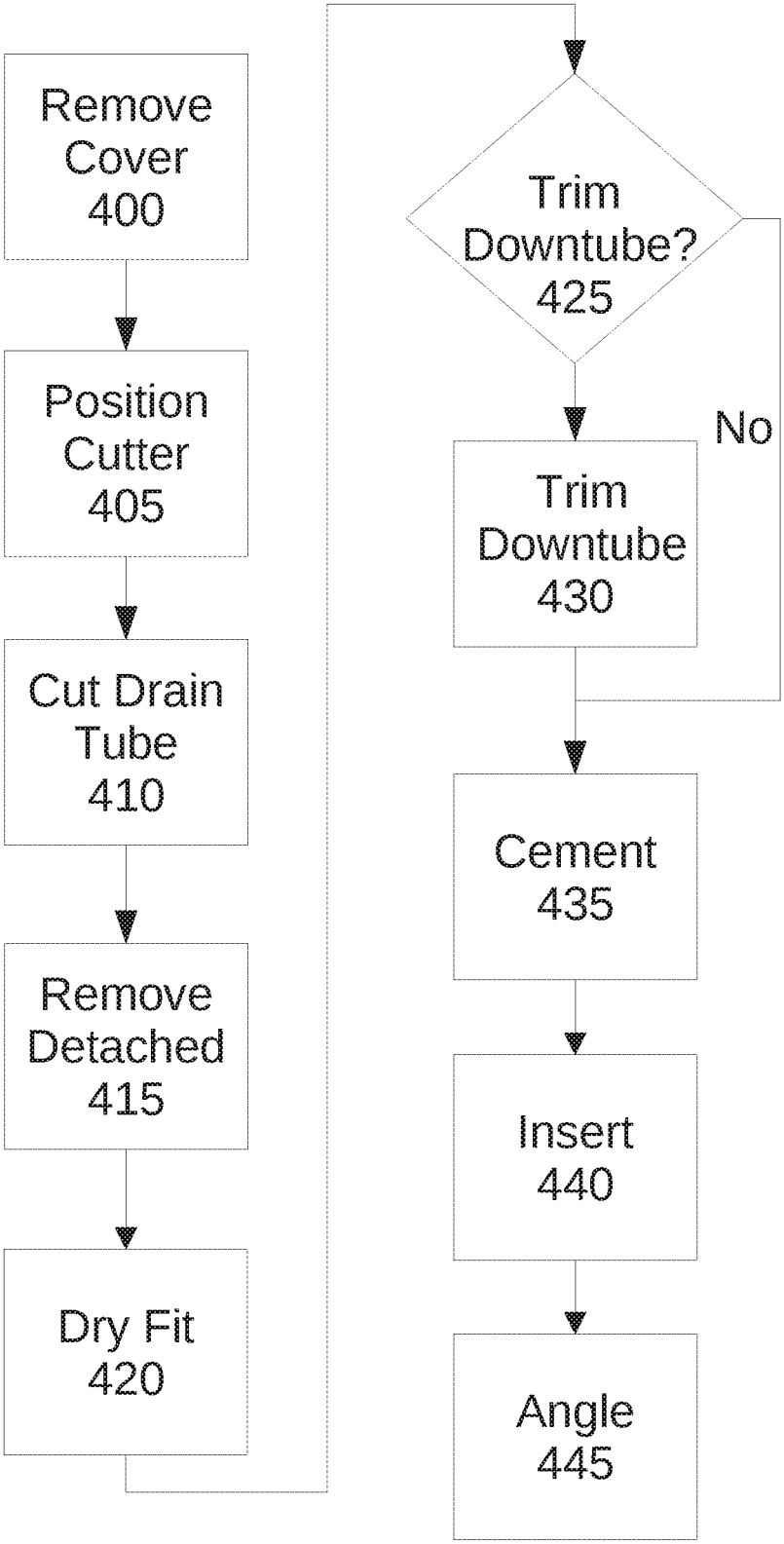
FIG. 21 is a high-level flowchart for a method of replacing a gutter drain using an exemplary gutter drain according to principles of the invention.

With reference to the flowchart of FIG. 21, a method of installing a drain 100 as a replacement drain in a pool gutter 300 includes removing the cover of the original drain, as in step 400. Removal of the cover provides access to the interiors of the hopper and drain tube of the drain to be replaced.

In step 405, a cutter is positioned for cutting the drain to be replaced at the drain tube. The cutter is an internal pipe cutter. Positioning entails determining the location of the cut in the drain pipe. The drain pipe, and the surrounding portion of the drain tube, should be cut at a depth that allows mating of the downtube 160 of the replacement drain tube with the drain pipe 200. Thus, if the downtube 160 of the replacement drain is 2" in length, and a good joint requires at least ¾" inch of the downtube 160 inserted in the drain pipe 200, then the depth of the cut should not be deeper than 1.25" below the top 155 of the drain tube 170 of the replacement drain 100.

After the position for the cut has been determined, the cut is made as in step 410. The cut is made using an internal pipe cutter, proceeding first through the drain pipe 200 and then through the overlapping portion 205 of the drain tube of the drain to be replaced.

After the cut, the severed portion of the drain to be replaced is removed, as in step 415. As the drain is typically comprised of PVC, which does not bond with the cementitious gutter structure, removal typically entails lifting or pulling the drain from the gutter structure, leaving behind a cavity shaped according to the outer surfaces of the removed portion of the drain. The cut portion 205 of drain tube surrounding the drain pipe 200 remains embedded in the gutter structure below the cavity.

Next, the replacement drain 100 is dry fitted, as in step 420. This entails inserting the drain tube 170 in the cavity, with the downtube 160 of the replacement drain 100 extending into the drain pipe 200. The hopper 120 is fitted to the top 155 of the drain tube 170. The objective is to position the hopper flush with the pitched surface of the gutter. The hopper 102 should be at the desired elevation and angle, i.e., an elevation and angle flush with the pitched top surface of the gutter when refinished.

After dry fitting, a determination is made whether or not to trim the drain tube of the replacement drain, as in step 425. If the downtube 160 is too long to allow the hopper 120 to be flush with the pitched surface of the gutter, the downtube 160 may be cut, as in step 430. During dry fitting in step 420, if the hopper 102 cannot be made flush because the downtube is too long, then the distance between the top 105 of the hopper 102 and the pitched surface of the gutter is about the length of the downtube 106 that should be cut off for a flush fit. By way of example, if the downtube is 4"

long and only 2" is needed, the downtube may be cut to the needed length, as in step 430. As the replacement drain is not yet installed, the downtube may be cut using an external or internal cutter.

After any trimming, a bonding agent (e.g., PVC cement) may be applied to the outer surface of a portion of the downtube 160 of the replacement drain, the portion being the portion to be inserted into the drain pipe 200, as in step 435. Cement may also be applied to the socket 157*c*, 158 and/or convex 130 or spherical portion 131*c* of the joint. Surfaces may be cleaned and primed before a bonding agent is applied.

Then the replacement drain is installed by inserting the downtube 160 in the drain pipe 200, as in step 440. The portion of the downtube to which the bonding agent has been applied is inserted into the drain pipe 200, while the hopper 102 of the replacement drain 100 is mated with the drain tube 170, and positioned within the cavity in the gutter, with the top 155 of the hopper 102 about flush with the pitched top surface of the gutter 300 after refinishing.

The angle of the top 155 of the hopper 102 may be adjusted to be the same as the pitch of the gutter, as in step 445. This entails adjusting the angle before the bonding agent dries. Inserting the downtube 160 to the correct depth while adjusting the angle of the hopper can be accomplished quickly in series, or together simultaneously, before the applied bonding agent dries.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. An adjustable gutter drain assembly comprising:

a gutter of a swimming pool, the gutter having a pitched surface;

a vertical drain pipe in the gutter below the pitched surface of the gutter;

an adjustable gutter drain fluidly coupled to the vertical drain pipe, the adjustable gutter drain comprising:

a hopper, the hopper comprising a receptacle with an open top, a bottom, a first joint member at the bottom, and a passage extending from the receptacle through the first joint member, the open top being substantially flush with the pitched surface of the gutter; and a drain tube comprising a drain tube top, a second joint member, and a downtube, the downtube extending from the drain tube top, the second joint member being formed at the drain tube top, and a channel extending through the second joint member and the downtube, the downtube mating with and extending into the vertical drain pipe; and the first joint member abutting and being attached to the second joint member, one of the first joint member and the second joint member being a negative impression of the other of the first joint member and the second joint member, and an angle of the first joint member relative to the second joint member being determined to angle the open top of the hopper flush with the pitched surface of the gutter.

2. The adjustable gutter drain assembly of claim 1, the vertical drain pipe being a 2-inch nominal pipe size Schedule 40 PVC drain pipe, the downpipe fitting within the drain pipe.

3. The adjustable gutter drain assembly of claim 2, the downpipe having an outer diameter of about 2.047 inches.

4. The adjustable gutter drain assembly of claim 2, the downpipe having an outer diameter between 2.03 and 2.05 inches.

5. The adjustable gutter drain assembly of claim 1, the first joint member comprising a concave projection extending from the bottom of the hopper.

6. The adjustable gutter drain assembly of claim 5, the concave projection comprising a spherical cap.

7. The adjustable gutter drain assembly of claim 1, the first joint member comprising a spherical cap extending from the bottom of the hopper.

8. The adjustable gutter drain assembly of claim 1, the first joint member being attached to the second joint member with PVC cement, and the downtube being attached in the vertical drain pipe with PVC cement.

* * * * *